US008168039B2

(12) United States Patent
Levit

(10) Patent No.: US 8,168,039 B2
(45) Date of Patent: May 1, 2012

(54) ELECTROCONDUCTIVE ARAMID PAPER AND TAPE MADE THEREFROM

(75) Inventor: Mikhail R. Levit, Glen Allen, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 71 days.

(21) Appl. No.: 12/768,987

(22) Filed: Apr. 28, 2010

(65) Prior Publication Data

US 2010/0206502 A1 Aug. 19, 2010

Related U.S. Application Data

(63) Continuation-in-part of application No. 11/138,252, filed on May 26, 2005, now abandoned.

(51) Int. Cl.
*D21F 11/00* (2006.01)

(52) U.S. Cl. ..... 162/157.3

(58) Field of Classification Search ..... 162/157.3
See application file for complete search history.

(56) References Cited

U.S. PATENT DOCUMENTS

| | | | |
|---|---|---|---|
| 2,999,788 | A | 9/1961 | Morgan |
| 3,018,091 | A | 1/1962 | Duggins |
| 3,063,966 | A | 11/1962 | Kwolek et al. |
| 3,133,138 | A | 5/1964 | Alexander, Jr. |
| 3,287,324 | A | 11/1966 | Sweeny |
| 3,756,908 | A | 9/1973 | Gross |
| 3,767,756 | A | 10/1973 | Blades |
| 3,869,430 | A | 3/1975 | Blades |
| 4,481,060 | A | 11/1984 | Hayes |
| 4,888,091 | A | 12/1989 | Nollen et al. |
| 5,084,136 | A | 1/1992 | Haines et al. |
| 5,126,012 | A | 6/1992 | Hendren et al. |
| 5,233,094 | A | 8/1993 | Meyer |
| 5,316,839 | A | 5/1994 | Kato et al. |
| 2003/0022571 | A1 | 1/2003 | Auza et al. |

FOREIGN PATENT DOCUMENTS

| | | |
|---|---|---|
| EP | 0073668 | 3/1983 |
| EP | 0468471 | 1/1992 |

OTHER PUBLICATIONS

Meta Aramids (NOMEX®—CONEX) NOMEX®, Internet Article, Retrieved from the Internet: URL:http://www.albarrie.com/Fabric/aramid-meta.html> [retrieved on Mar. 27, 2007] Paragraph with title "Dimensional Stability at High Temperatures".

*Primary Examiner* — Mark Halpern

(57) ABSTRACT

This invention relates to a tape made from an aramid paper, and a process for making the paper, the papers comprising 5 to 65 parts by weight aramid fiber, 30-90 parts by weight aramid fibrids, and 1-20 parts by weight of conductive filler, based on the total weight of the aramid fiber, fibrids, and filler; the paper having an apparent density of not more than 0.43 g/cm$^3$ and a tensile index not less than 60 Nm/g.

7 Claims, No Drawings

ELECTROCONDUCTIVE ARAMID PAPER AND TAPE MADE THEREFROM

RELATED APPLICATION

The present patent application is a continuation in part of application Ser. No. 11/138,252 filed May 26, 2005.

BACKGROUND OF THE INVENTION

1. Field of the Invention

This invention relates to electroconductive aramid paper and tape made therefrom suitable for electrostatic discharge interference and/or electromagnetic interference shielding.

2. Description of Related Art

NOMEX® Type 843 Conductive Carbon Blend aramid paper consists of NOMEX® brand floc and fibrids blended with conductive carbon fibers. This paper has been available in both hot calendered and uncalendered versions. The uncalendered version of this paper has a basis weight of about 40 g/m$^2$, a density of about 0.29 g/cm$^3$, and a tensile strength of about 16 N/cm, which corresponds to tensile index of 40 N*m/g, and can be easily saturated with polymer resins. However, it has been found that this paper does not have adequate tensile strength for automated tape winding of conductors, resulting in breakage and tearing of aramid tapes when wrapped using the under the tensions normally used by automatic winding devices. The hot calendered version of this paper has an improved tensile strength of about 35 N/cm (a tensile index about 90 N*m/g) and is strong enough for the automated tape winding; however, this calendered paper is less saturable and less formable, because after calendering the resulting paper is denser (about 0.64 g/cm$^3$). The saturability of the paper is important for paper used as electrical insulation because in many applications the insulation is wrapped around a part, and the wrapped part is then impregnated with a polymer resin to substantially eliminate any air voids in the wrapping and to reduce the non-uniformity of electrical field and subsequent premature failure of the insulation. After the paper is wrapped around a part or another wrapping, the paper must be porous enough to allow polymeric resins to pass through the paper to fully impregnate both the paper and any other wrappings that might be present.

It is also desired that the conductive paper have a certain level of surface resistivity to avoid buildup of charge and provide an optimum electrical shielding in the particular application. Thus, a preferable surface resistivity of conductive tapes for the outside layers of the main wall insulation of coils in stators of high voltage motors is in the about 100 to 400 ohms/in$^2$ range. Also, it is very important to have a manufacturing process which allows a good control of surface resistivity of the final paper. The surface resistivity of the hot calendered lightweight NOMEX® paper type 843 (about 700 ohms/in$^2$ in the machine direction and about 1800 ohms/in$^2$ in the cross direction) is about seven times that of the uncalendered paper (95 ohms/in$^2$ in the machine direction and 250 ohms/in$^2$ in the cross direction).

U.S. Pat. No. 2,999,788 to Morgan; U.S. Pat. No. 3,756,908 to Gross; and U.S. Pat. No. 4,481,060 to Hayes disclose papers based on fibrids from synthetic polymers including papers from aromatic polyamide (aramid) fibrids and their combination with different fibers.

U.S. Pat. No. 5,233,094 to Kirayoglu et al. discloses a process for making strong paper comprising 45-97% by weight of p-aramid fiber, 3-30% by weight of m-aramid fibrids and 0-30% by weight of quartz fiber. The paper is produced by forming, calendering, and additional high temperature heat treatment at least at 510° F. (266° C.).

U.S. Pat. No. 5,126,012 to Hendren et al. discloses high strength aramid paper from floc and fibrids, and carbon fiber is among the possible types of the floc. Necessary mechanical properties are achieved after hot compression of the paper in the press at a temperature of 279° C.

U.S. Pat. No. 5,316,839 to Kato et al. discloses multilayered aramid paper with conductive fibers in the conductive layer of the structure. The paper is prepared by forming followed by hot compression or hot calendering at or above the glass transition temperature of polymetaphenylene isophthalamide (275° C.).

Previously, aramid papers with conductive fillers required hot calendering or hot compression to make the paper stronger and thereby suitable for automated tape winding. At the same time, calendering or hot compression significantly changes the electrical properties of the paper, as well as reducing its free volume and ability to be saturated and impregnated by a resin. What is needed therefore is a conductive aramid paper suitable for making a tape that has the desired electrical properties, is saturable by resins, and is also strong enough to be processed in automated tape winding machines.

BRIEF SUMMARY OF THE INVENTION

This invention relates to a tape made from aramid paper comprising 5 to 65 parts by weight aramid fiber, 30-90 parts by weight aramid fibrids, and 1-20 parts by weight of conductive filler, based on the total weight of the aramid fiber, fibrids, and filler; the paper having an apparent density of not more than 0.43 g/cm$^3$ and a tensile index not less than 60 Nm/g.

The invention is also directed to processes for making aramid paper and conversion to a tape comprising the steps of forming an aqueous dispersion of 5 to 65 parts by weight aramid fiber, 30-90 parts by weight aramid fibrids, and 1-20 parts by weight of conductive filler, based on the total weight of the aramid fiber, fibrids, and filler; blending the dispersion to form a slurry; draining the aqueous liquid from the slurry to yield a wet paper composition; drying the wet paper composition; and heat treating the paper at or above the glass transition temperature of the polymer in the aramid fibrids without consolidation of the paper and forming a tape.

DETAILED DESCRIPTION OF THE INVENTION

This invention relates to a tape made from an aramid paper comprising 5 to 65 parts by weight aramid fiber, 30-90 parts by weight aramid fibrids, and 1-20 parts by weight of conductive filler, based on the total weight of the aramid fiber, fibrids, and filler, the paper having an apparent density of not more than 0.43 g/cm$^3$ and a tensile index not less than 60 Nm/g. Surprisingly, the inventors have found that a strong paper with no significant changes in the paper free volume or surface resistivity can be made by heat-treating the formed paper at a temperature of about or above the glass transition temperature of the aramid polymer of the fibrids but without applying substantial pressure to the sheet in the heated state to consolidate or compress the paper.

The papers of this invention include fiber and fibrids made from aramid polymers. Aramid polymers are polyamides wherein at least 85% of the amide (—CO—NH—) linkages are attached directly to two aromatic rings. Additives can be used with the aramid and it has been found that up to as much as 10 percent, by weight, of other polymeric material can be blended with the aramid. Copolymers can be used having as much as 10 percent of other diamines substituted for the diamine of the aramid or as much as 10 percent of other diacid chlorides substituted for the diacid chloride of the aramid. Methods for making aramid polymers and fibers are disclosed in U.S. Pat. Nos. 3,063,966; 3,133,138; 3,287,324; 3,767,756; and 3,869,430. In some preferred embodiments of this invention the aramid polymers are meta- and para-oriented aramids, with poly(metaphenylene isophthalamide) and poly (paraphenylene terephthalamide) being the preferred aramid polymers.

The papers of this invention comprise aramid fiber. In many embodiments of this invention, the aramid fiber can be in the form of floc or pulp. By "floc" is meant fibers having a length of about 2 to 25 millimeters, preferably 3 to 7 millimeters; the fibers preferably have a diameter of about 3 to 20 micrometers, preferably 5 to 14 micrometers. If the floc length is less than about 2 millimeters it is difficult to make strong papers and if the length is more than about 25 millimeters, it is difficult to form a uniform web by a wet-laid method. If the floc diameter is less than about 3 micrometers, it can be difficult to produce it with adequate uniformity and reproducibility, and if it is more than about 25 micrometers, it is difficult to form a uniform paper having a low to medium basis weight. Floc is generally made by cutting continuous spun filaments or tows into specific-length pieces using conventional fiber cutting equipment.

The term "pulp", as used herein, means particles of aramid material having a stalk and fibrils extending generally therefrom, wherein the stalk is generally columnar and about 10 to 50 micrometers in diameter and the fibrils are fine, hair-like members generally attached to the stalk measuring only a fraction of a micrometer or a few micrometers in diameter and about 10 to 100 micrometers long. One possible illustrative process for making aramid pulp is generally disclosed in U.S. Pat. No. 5,084,136.

The papers of this invention comprise 5 to 65 parts by weight aramid fiber, and in some embodiments 30 to 50 parts by weight are preferred. It is believed that less that 5 parts by weight results in a paper that is too brittle and does not have sufficient tear properties, while papers having more than 65 parts by weight of aramid fibers results in a corresponding reduction in the amount of fibrids available in the composition to help bind the composition together, which results in an unacceptable reduction in paper tensile strength. In some embodiments of this invention, the preferred types of the fiber useful in this invention are poly(metaphenylene isophthalamide)floc, poly(paraphenylene terephthalamide)pulp, and poly(paraphenylene terephthalamide)floc, with poly (metaphenylene isophthalamide)floc being the most preferred fiber.

The papers of this invention also comprise aramid fibrids. The term "fibrids" as used herein, means a very finely-divided polymer product of small, filmy, essentially two-dimensional, particles known having a length and width on the order of 100 to 1000 micrometers and a thickness only on the order of 0.1 to 1 micrometer. Fibrids are made by streaming a polymer solution into a coagulating bath of liquid that is immiscible with the solvent of the solution. The stream of polymer solution is subjected to strenuous shearing forces and turbulence as the polymer is coagulated. Aramid fibrids can be prepared using a fibridating apparatus where a polymer solution is precipitated and sheared in a single step as described in U.S. Pat. No. 3,756,908 or 3,018,091.

The papers of this invention comprise 30 to 90 parts by weight aramid fibrids. It is believed that papers having less that 30 parts by weight fibrids do not have adequate tensile strength for most preferred applications, while papers having more than 90 parts by weight are not only typically too brittle and do not have sufficient tear properties for many processing steps, but also such high fibrid content papers have very limited resin impregnability even at low density. In some embodiments, the papers of this invention preferably have an aramid fibrid content of about 35 to 60 parts by weight. In some embodiments of this invention, the preferred aramid fibrids of this invention are made from meta-aramid polymer, with the most preferred meta-aramid being poly(metaphenylene isophthalamide).

The aramid fiber and fibrids used in the paper of this invention can be the natural color of the spun filament or can be colored by dyes or pigments. The fiber can also be treated by materials that alter its surface characteristics so long as such treatment does not adversely affect the ability of binders to contact and hold to the fiber surfaces.

The papers of this invention further include a conductive filler. By "conductive filler" it is meant any fibrous or particulate (such as a powder or a flake) form having a conductivity over a wide range, such as a conductivity typical for conductors of greater than about $10^2$ siemens/meter, to a conductivity typical for semiconductors of from about $10^{-8}$ to $10^2$ siemens/meter). The structure of the conductive filler can be chosen based on the particular application requirements and the conductive filler can be relatively homogenous, where substantially all the volume of the material can conduct electricity (such as metal fibers, carbon fibers, carbon black, etc.) or the material can be heterogeneous, where conductive and dielectric parts co-exist in the volume of the material (such as metal coated fibers or particles, or fibers or particles filled with conductive ingredients).

The papers of this invention comprise 1 to 20 parts by weight conductive filler. It is believed that less that 1 part by weight results in a paper that does not provide an adequate amount of conduction for many applications, while having more than 20 parts by weight usually results in noticeable reduction of the paper mechanical properties. In some preferred embodiments the conductive filler is carbon fiber, and in other preferred embodiments the conductive filler is carbon black. The most preferred conductive filler that is useful in many versions of the inventive paper is carbon fiber.

The papers of this invention have an apparent density of not more than 0.43 g/cm$^3$ and a tensile index of not less than 60 Nm/g. Such papers can be used in any interference discharge or shielding application and can be easily taped and impregnated with a resin. The apparent density describes the weight-to-volume ratio of the paper and is determined in accordance with ASTM D202. The tensile index describes the tensile strength-to-basis weight (grammage) ratio and is determined in accordance with ASTM D828. In some embodiments of this invention, the papers of this invention have a final basis weight of about 30 to 60 g/m$^2$ and have a final thickness of about 0.08 to 0.16 mm.

The papers of this invention are generally impregnated with resins either prior to or after they are installed in/on an electrical device or conductor. Such resins include epoxy resins, polyesterimide resins, and other resin systems. It has been found that it is critical that the papers of this invention have an apparent density of not more than about 0.43 g/cm$^3$ to be formable and to allow fast impregnation with typical resins. A higher density provides a structure that is too consolidated to be formable or to allow fast resin impregnation. Further, it is thought the apparent density of the paper can be as low as 0.15 g/cm$^3$ or lower, depending on the application, the resin used, and the amount of resin used.

For preventing electrical discharges in electrical machines, tapes made from the papers of this invention are generally applied on the conductor coils using automated tape winding machines, and it has been found that a tensile index of not less than 60 Nm/g is necessary to avoid excessive breakout or tearing of the papers in these machines.

Additional ingredients, such as other fillers for the adjustment of paper corona resistance and other properties, or pigments or antioxidants, etc., in powder, flake or fibrous form can be added to the paper composition of this invention, provided they do not affect increase the apparent density nor reduce the tensile index to unacceptable levels.

This invention also relates to a process for making aramid paper, comprising the steps of:

a) forming an aqueous dispersion √of 5 to 65 parts by weight aramid fiber, 30-90 parts by weight aramid fibrids, and 1-20 parts by weight of conductive filler, based on the total weight of the aramid fiber, fibrids, and filler,
b) blending the dispersion to form a slurry,
c) draining the water from the slurry to yield a wet paper composition,
d) drying the wet paper composition, and
e) heat treating the paper at or above the glass transition temperature of the polymer in the aramid fibrids without consolidation of the paper.

The first step of this invention involves forming a dispersion of aramid fiber, aramid fibrids and conductive filler in an aqueous liquid such as water. The dispersion can be made either by dispersing the fibers and then adding the fibrids and other materials or by dispersing the fibrids and then adding the fibers and other materials. The dispersion can also be made by combining a first dispersion of fibers with a second dispersion of the fibrids and other materials. Any number of possibilities of combining fiber, fibrids, and other materials is possible however in one preferred embodiment the concentration of fibers in the final dispersion is about 0.01 to 1.0 weight percent based on the total weight of the dispersion. In other preferred embodiments, the concentration of the fibrids in the dispersion is up to about 95 weight percent based on the total weight of solids.

The aqueous liquid of the dispersion is generally water, but may include various other materials such as pH-adjusting materials, forming aids, surfactants, defoamers and the like.

The second step in the process for making the papers of this invention is blending the dispersion to form a slurry. The dispersion can be blended in a totally separate step or vessel or the dispersion can be blended essentially simultaneously while being formed, and the blending may be accomplished in the same vessel that forms the dispersion. Blending can be accomplished by any known means, such as by agitation of the dispersion by, say, a stirring device, or by refining the dispersion in a refiner, or in some embodiments blending can be accomplished by pumping the dispersion at a rate to provide adequate turbulence to blend the materials.

The third step in the process for making the paper of this invention involves draining the aqueous liquid from the second slurry to yield a wet paper composition. In some embodiments, the aqueous liquid is drained from the dispersion by conducting the dispersion onto a screen or other perforated support, retaining the dispersed solids and then passing the liquid to yield a wet paper composition. For example, the papers of this invention can be formed on equipment of any scale from laboratory screens to commercial-sized papermaking machinery, such as a Fourdrinier or inclined wire machines.

The next step in the process for making the paper of this invention involves drying the wet paper composition. In many embodiments of the process of this invention the wet paper composition, once formed on the support or screen, is further dewatered by vacuum or other pressure forces and further dried by evaporating the remaining liquid using a dryer, oven, or similar device known in the art for drying webs and papers.

The final step in the process for making the paper of this invention involves heat treating the paper at or above the glass transition temperature of the polymer in the fibrids without consolidation of the paper. For poly(m-phenylene isophthalamide) glass transition is about 275° C.

The heat-treatment can be conducted in line with forming or as a separate processing step. Surprisingly, the inventors have found that a strong paper with no significant changes in the paper free volume or surface resistivity can be made by heat-treating the formed paper at a temperature of about or above the glass transition temperature of the aramid polymer of the fibrids but without applying substantial pressure to the sheet in the heated state to consolidate or compress the paper. Therefore, this process does not involve any of the preliminary compression or subsequent calendering steps to consolidate the sheet structure as is typical in prior art processes. If desired, the paper can be restrained while heat treated to help reduce shrinkage.

Heat-treatment can be accomplished by any known method of heating including, but not limited to contact heating with paper touching hot surface of metal rolls or other hot surfaces, by conventional heating such as by infrared or hot-air heating in an oven.

The paper of this invention is useful as a conductive material with tailored level of electrical properties for electrostatic discharge interference and/or electromagnetic interference shielding. For example, it can be used as a conductive tape for electrostatic discharge in the slots of the stators of high voltage rotating machines.

Test Methods

Thickness and Basis Weight (Grammage) were determined for papers of this invention in accordance with ASTM D 374 and ASTM D 646 correspondingly. At thickness measurements, method E with pressure on specimen of about 172 kPa was used.

Density (Apparent Density) of papers was determined in accordance with ASTM D 202.

Tensile Index was determined based on the tensile test on an Instron-type testing machine using test specimens 2.54 cm wide and a gage length of 12.7 cm in accordance with ASTM D 828.

Surface Resistivity was measured in accordance with ASTM D 257 on about 2.54 cm wide strips of the paper.

EXAMPLES

Physical properties of all the paper samples made in the examples are shown in the Table.

Example 1

An aqueous dispersion was made of never-dried poly (metaphenylene isophthalamide) (MPD-I) fibrids at a 0.5% consistency (0.5 weight percent solid materials in water). Carbon fiber was added to this dispersion. After about ten minutes of continued agitation, additional water and meta-aramid floc were added with additional agitation of about ten minutes to completely blend the materials and to yield a slurry having a final consistency of 0.35%. The final slurry was comprised of the following solids by weight: 39% MPD-I floc, 50% MPD-I fibrids, and 11% carbon fiber.

The MPD-I fibrids were made using the general method as disclosed and described in U.S. Pat. No. 3,756,908. The MPD-I floc had a linear density of 0.22 tex (2.0 denier), a cut length of 0.64 cm, and an initial modulus of about 800 cN/tex (sold by DuPont under the trade name NOMEX®). The carbon fiber was FORTAFIL fiber type 150 (length of 0.32 cm), available from FORTAFIL Inc.

The slurry was pumped to a supply chest and fed from there to a Fourdrinier machine to make paper having a basis weight of about 30.9 g/m$^2$. The paper was then heat treated by surface contact on heated metal rolls having a surface temperature of about 320° C. and a contact residence time of about 7 seconds. A 2 cm wide tape made from this paper was successfully wrapped without breakage or tearing on a coil using an automated winding process.

Example 2

A slurry was prepared as in Example 1, however the final slurry was comprised of the following solids by weight: 40% MPD-I floc, 50% MPD-I fibrids, and 10% carbon fiber. A paper with a basis weight of 50.2 g/m$^2$ was formed on a Fourdrinier and additionally heat-treated as in Example 1. A 2 cm wide tape from this paper was successfully wrapped without breakage or tearing on a coil using an automated winding process.

Example 3

A slurry was prepared as in Example 1, however the final slurry was comprised of the following solids by weight: 44% MPD-I floc, 50% MPD-I fibrids, and 6% carbon fiber. A paper with a basis weight of 53.9 g/m$^2$ was formed on a Fourdrinier and additionally heat-treated as in Example 1. A 2 cm wide tape from this paper was successfully wrapped without breakage or tearing on a coil using an automated winding process.

Example 4

A slurry was prepared as in Example 1, however the final slurry was comprised of the following solids by weight: 60% MPD-I floc, 40% MPD-I fibrids, and 10% carbon fiber. A paper with a basis weight of 45.8 g/m$^2$ was formed on a Deltaformer inclined wire machine and additionally heat-treated as in Example 1. A 2 cm wide tape from this paper was successfully wrapped without breakage or tearing on a coil using an automated winding process.

Example 5

172 g of an aqueous, never-dried, meta-aramid fibrid slurry (0.58% consistency and freeness 330 ml of Shopper-Riegler), 0.34 g of carbon black and 0.66 g of meta-aramid floc were placed together in a laboratory mixer (British pulp evaluation apparatus) with about 1600 g of water and agitated for 1 min. The final slurry was comprised of the following solids by weight: 33% MPD-I floc, 50% MPD-I fibrids, and 17% carbon black.

The MPD-I floc and MPD-I fibrids were the same as described in Example 1. The carbon black was Ketjenblack®EC300J produced by Akzo Nobel Co. The dispersion was poured, with 8 liters of water, into an approximately 21×21 cm handsheet mold and a wet-laid sheet was formed. The sheet was placed between two pieces of blotting paper, hand couched with a rolling pin and dried in a handsheet dryer at 190° C. After drying, the sheet was heat treated in a restrained position (fixed by metal clips to a metal plate) in an oven at 300° C. for 20 min.

Comparative Example A

A paper was prepared as in Example 5, but without additional heat treatment after drying. As a result, tensile index of the paper was significantly lower than necessary for the automated taping operation.

Comparative Example B

A paper was prepared as in Example 5, but instead of additional heat treatment after drying, the sheet was passed through the nip of a metal-metal calender with a roll diameter of about 20 cm at a temperature of about 300° C. and a linear pressure of about 3000 N/cm.

Comparative Examples C-F

Papers were formed as described in Examples 1-4 correspondingly, but additional heat-treatment was not conducted. During automated taping of 2 cm wide tapes from these papers, breaks occurred.

Comparative Example G

The paper from Example 1 was passed through the nip of a metal-metal calender with a roll diameter of about 20 cm at a temperature of about 300° C. and a linear pressure of about 1200 N/cm.

Comparative Example H

A paper was formed as described in Example 2, calendered in the soft nip calender at ambient temperature and linear pressure of 870 N/cm, and heat treated at the same conditions as described in Example 1.

As can be seen from Table 1, the tensile index of the inventive papers (Examples 1-5) ranges from 61 to 87 N/cm, which is close to tensile index for calendered paper of the same composition (Examples B, G, & H) which range from 68-85; however, apparent density values for the inventive papers (Examples 1-5) ranges between 0.28 to 0.41 g/cm$^3$ are almost the same as for the formed precursor paper represented by Examples A & C-F, which range between 0.27 to 0.40 g/cm$^3$.

Surface resistivity of the inventive papers is also very close to surface resistivity of the formed precursors (compare Examples 1 and C, 2 and D, 3 and E, 4 and F, 5 and A). The biggest difference in resistivity for formed and heat treated papers versus formed papers is for the pair of Examples 3 and E (the change in about 2.4 times), but it is still much lower than after calendering (described below).

Examples G and H illustrate that the surface resistivity of calendered papers with carbon fiber is much higher than the resistivity of the formed precursors represented by Examples C and D or formed and heat treated paper represented by Examples 1 and 2.

Examples A and B illustrate that the surface resistivity of calendered paper with carbon black (Example B) is 10 times lower that the resistivity of the corresponding formed precursor (Example A). This reaction, which is different from that of papers made with carbon fibers, is believed to be due to the brittleness of carbon fiber and there is significant crushing and length reduction of these fibers when they are compressed in the nip of the calender, resulting in a corresponding increase in the surface resistivity. Such effect can be less pronounced for heavier papers, but for practically important lightweight papers (60 g/m$^2$ and less) this is very negative factor. Also, more uniform paper formation can reduce the scale of the effect; however, the economics of the paper manufacturing always limits such opportunity. In the case of such conductive powder filler as a carbon black, it is believed that there is significant reduction in the paper resistivity after calendering due to the higher volume concentration of the conductive elements of the structure (i.e., the particles) without any change to their individual size. The main problem with calendering of the papers with both types of conductive fillers (carbon fiber and carbon black), as shown in the examples, is the dramatic change in surface resistivity after calendering.

TABLE 1

Properties of Papers

| Example | Basis wt. (g/m$^2$) | Thickness (mm) | Density (g/cm3) | Tensile index in MD (N/cm) | Surface resistivity (Ohms/sq.) MD | Surface resistivity (Ohms/sq.) CD |
|---|---|---|---|---|---|---|
| 1 | 33.8 | 0.091 | 0.37 | 73 | 187 | 350 |
| 2 | 51.9 | 0.134 | 0.39 | 75 | 212 | 311 |
| 3 | 55.6 | 0.134 | 0.41 | 87 | 2900 | 5900 |
| 4 | 52.2 | 0.163 | 0.32 | 61 | 116 | 218 |
| 5 | 43.1 | 0.163 | 0.28 | 61 | 3500 | — |
| A | 42.7 | 0.160 | 0.27 | 39 | 3300 | — |
| B | 43.1 | 0.064 | 0.68 | 68 | 315 | — |
| C | 30.9 | 0.085 | 0.36 | 42 | 134 | 254 |

TABLE 1-continued

Properties of Papers

| Example | Basis wt. (g/m$^2$) | Thickness (mm) | Density (g/cm3) | Tensile index in MD (N/cm) | Surface resistivity (Ohms/sq.) MD | Surface resistivity (Ohms/sq.) CD |
|---|---|---|---|---|---|---|
| D | 50.2 | 0.127 | 0.40 | 48 | 155 | 226 |
| E | 53.9 | 0.129 | 0.40 | 51 | 1200 | 2200 |
| F | 45.8 | 0.151 | 0.31 | 27 | 100 | 179 |
| G | 33.8 | 0.045 | 0.75 | 81 | 1500 | 6000 |
| H | 55.6 | 0.114 | 0.48 | 85 | 10^6 | 10^6 |

What is claimed is:

1. A tape comprising aramid paper comprising 5 to 65 parts by weight aramid fiber, 30-90 parts by weight aramid fibrids, and 1-20 parts by weight of conductive filler, based on the total weight of the aramid fiber, fibrids, and filler, the paper having an apparent density of not more than 0.43 g/cm$^3$ and a tensile index not less than 60 Nm/g.

2. The tape of claim 1, wherein the conductive filler is carbon fiber.

3. The tape of claim 1, wherein the aramid fiber is poly (metaphenylene isophtalamide) fiber.

4. The tape of claim 2, wherein the aramid fiber is poly (metaphenylene isophthalamide) fiber.

5. The tape of claim 1, wherein the paper has a basis weight of 30 to 60 grams per square meter.

6. The tape of claim 1, wherein the paper has a final thickness of 0.08 to 0.16 mm.

7. The tape of claim 1, wherein the paper further comprises an epoxy resin or polyesterimide resin.

* * * * *